US005189736A

United States Patent [19]

Price

[11] Patent Number: 5,189,736

[45] Date of Patent: Mar. 2, 1993

[54] EXERCISE GARMENT

[76] Inventor: Lisa N. Price, 223 Brightwood Pl., San Antonio, Tex. 78209

[21] Appl. No.: 711,171

[22] Filed: Jun. 5, 1991

[51] Int. Cl.[5] ..... A41D 1/22; A41D 7/00

[52] U.S. Cl. ..... 2/69; 2/67; 450/22; 450/23; 450/27

[58] Field of Search ..... 2/69, 67, 70, 78 A, 2/79, 109, 110; 450/1, 3, 7, 15, 16, 22, 23, 27

[56] References Cited

U.S. PATENT DOCUMENTS

| | | | |
|---|---|---|---|
| 1,205,446 | 11/1916 | Gidden | 2/78 A |
| 1,599,637 | 9/1926 | Buchanan . | |
| 1,793,145 | 2/1931 | Vizzard | 450/22 |
| 1,957,102 | 5/1934 | Earnshaw | 2/67 |
| 2,060,689 | 11/1936 | Read | 2/67 |
| 4,026,547 | 5/1977 | Silverstolpe et al. . | |
| 4,179,754 | 12/1979 | Denu | 2/67 |
| 4,625,336 | 12/1986 | Derderian | 2/79 |
| 4,698,847 | 10/1987 | Yoshihara . | |
| 4,746,318 | 5/1988 | Moyer . | |
| 4,789,372 | 12/1988 | Wicks . | |
| 4,866,789 | 9/1989 | Dorm . | |
| 4,956,878 | 9/1990 | Boyton | 2/67 |
| 4,983,140 | 1/1991 | Gimble | 2/109 |
| 5,040,524 | 8/1991 | Votel et al. | 2/305 |
| 5,042,092 | 8/1991 | Ewing | 2/70 X |
| 5,046,194 | 9/1991 | Alaniz et al. | 2/79 X |

FOREIGN PATENT DOCUMENTS

| | | | |
|---|---|---|---|
| 460901 | 9/1926 | Fed. Rep. of Germany | 2/67 |
| 2217579 | 11/1989 | United Kingdom | 2/67 |

*Primary Examiner*—Werner H. Schroeder
*Assistant Examiner*—Jeanette E. Chapman
*Attorney, Agent, or Firm*—Richard J. Smith

[57] ABSTRACT

A support garment for use during exercise. A front panel is connected to a left rear panel and a right rear panel. A left front panel strap is adapted to be connected to a left rear panel strap, and a right front panel strap is adapted to be connected to a right rear panel strap. A belt is connected to the rear of the garment at approximately the center thereof. The garment enables the wearer's shoulders to provide support to the lower back and gluteal/pelvic area by pulling upward from the shoulders. The two ends of the belt are pulled forward and upward and fastened at the approximately the waist of the wearer.

20 Claims, 5 Drawing Sheets

EXERCISE GARMENT

FIELD OF THE INVENTION

The present invention relates to the field of exercise apparel. More particularly, the present invention relates to a support garment for use during exercise to reduce the resulting stress on the lower back and pelvic area.

BACKGROUND OF THE INVENTION

The biomechanics of exercise typically result in increased stresses on the lower back and buttocks or gluteal region. This is particularly true for female runners and aerobic exercisers. The result of such increased stress is typically lower back pain and potential pelvic stress fractures.

Prior efforts at alleviating the biomechanical stresses associated with the female body have typically focused on support of the abdomen of expectant mothers and/or breasts of the female aerobic exerciser. Examples of such maternity garments are shown in U.S. Pat. No. 4,746,318 and U.S. Pat. No. 4,789,372. However, these garments are not directed to the support of the lower back and gluteal/pelvic region.

SUMMARY OF THE INVENTION

Accordingly, the present invention provides a support garment especially adapted for use by females during exercise. The garment enables the shoulders to provide support to the lower back and gluteal/pelvic region or area by pulling up from the shoulders, thereby lifting the seat area and relieving the lower back and pelvic region from gravity pull during exercise.

The exercise garment of the present invention comprises a left rear panel and a right rear panel having a left rear panel strap and a right rear panel strap, respectively. A front panel is connected to the rear panels at a crotch area and at a left and right side, the left and right side connections being forward of a coronal plane of the wearer during use of the garment. The front panel also has a left front panel strap and a right front panel strap adapted to be connected to the left rear panel strap and the right rear panel strap, respectively, at the shoulders. The straps are adjustable and provide support for the lower back and gluteal/pelvic region or area during use. The garment further comprises a belt connected to the rear panels at a seam which lies in approximately the median sagittal plane of the wearer during use. The belt has left and right ends adapted to be pulled forward and upward and fastened at the waist during usage of the garment. The belt provides additional support to the lower back and gluteal region.

The exercise garment of the present invention further provides a method for supporting the lower back and pelvic region of a person during exercise comprising the steps of positioning a garment panel about the gluteal region or buttocks area of the person, pulling the garment panel upward from the shoulders of the person, and fastening a belt about the waist of the person, the belt being connected to approximately the center of the garment panel. The fastening step comprises the steps of pulling the belt upward and forward about the waist of the person and securing opposite ends of the belt at a desired adjustable tightness about the waist of the person.

DETAILED DESCRIPTION OF THE PREFERRED EMBODIMENT

Figure 1:
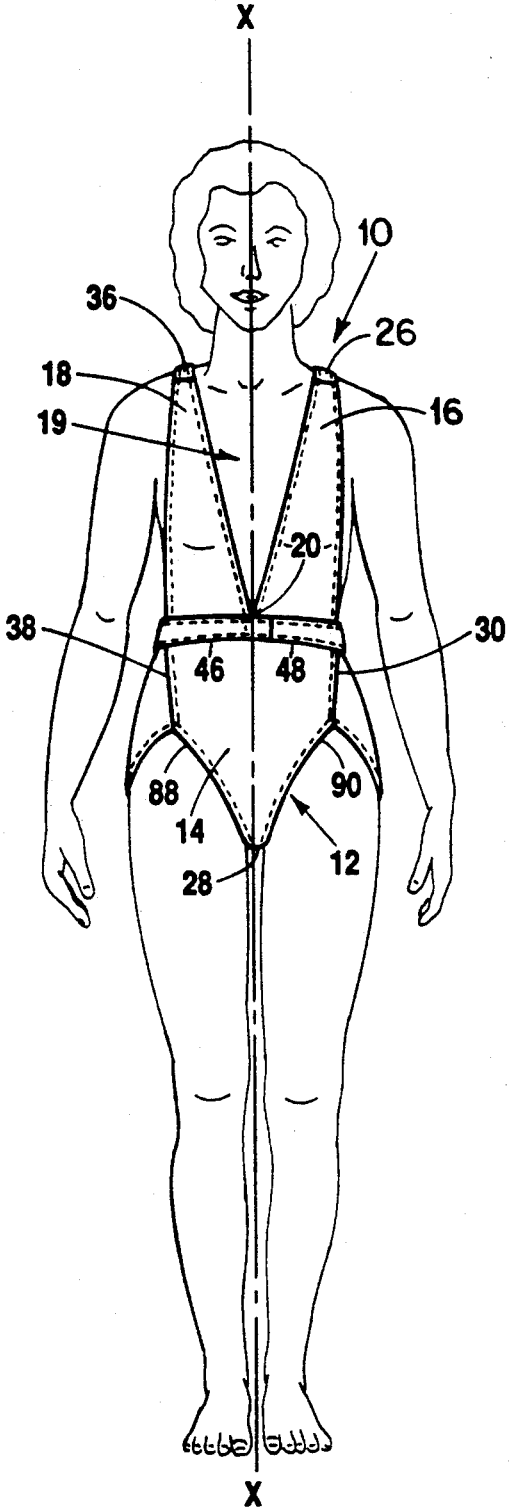
FIG. 1 is a frontal or ventral view of the exercise garment of the present invention as worn by a person.

Referring to FIG. 1, the exercise garment of the present invention is identified by the number 10. The garment 10 is shown as worn by a person having a median sagittal plane X—X which divides the body into right and left halves. Garment 10 comprises a front panel 12 having a lower midsection area 14, a left front panel strap 16 and a right front panel strap 18. Panel 12 provides or defines a generally V-shaped vental opening or open area 19 which extends from approximately the waist to the shoulders of the wearer. During usage of the garment 10, the apex 20 of opening 19 lies approximately within plane X—X.

Figure 2:
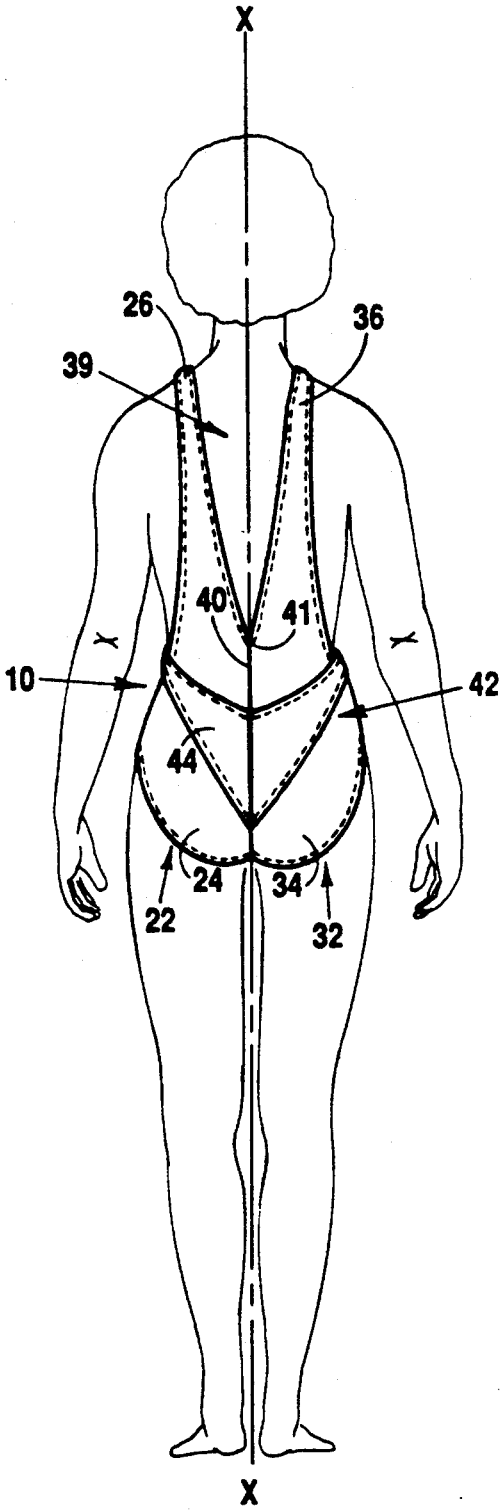
FIG. 2 is a rear or dorsal view of the exercise garment of the present invention as worn by a person.

Referring to FIG. 1 and FIG. 2, the exercise garment 10 will be described in greater detail. The garment 10 further comprises a left rear panel 22 having a lower buttocks area 24 and a left rear panel strap 26. Left rear panel 22 is connected to front panel 12 at crotch seam 28 and at side seam 30. Referring again to FIG. 2, the exercise garment 10 further comprises a right rear panel 32 having a lower buttocks area 34 and a right rear panel strap 36. Right rear panel 32 is connected to front panel 12 at crotch seam 28 and at side seam 38. Left rear panel 22 and right rear panel 32 are also sewn together at seam 40. When panel 22 and panel 32 are sewn together, they define a rear panel having a center line at approximately seam 40. Left rear panel 22 and right rear panel 32 provide or define a generally V-shaped dorsal opening or open area 39 which extends from approximately the wearer's lower back to the shoulders. During usage of the garment 10, seam 40 and the apex 41 of opening 39 lie approximately within plane X—X.

Referring to FIGS. 1–4, the exercise garment 10 further comprises a belt 42 which is sewn to left rear panel 22 and right rear panel 32 at seam 40. Belt 42 is generally V-shaped and has a rear area 44, a right end or strap 46 and a left end or strap 48. Belt 42 is attached at seam 40 at a position which is generally below the natural horizontal waistline of the wearer during usage of the garment 10. Belt 42 is angled upward from its attachment at seam 40. Straps 46 and 48 are adapted to be adjustably fastened together during usage of the garment 10 as described in greater detail hereinbelow.

Figure 3:
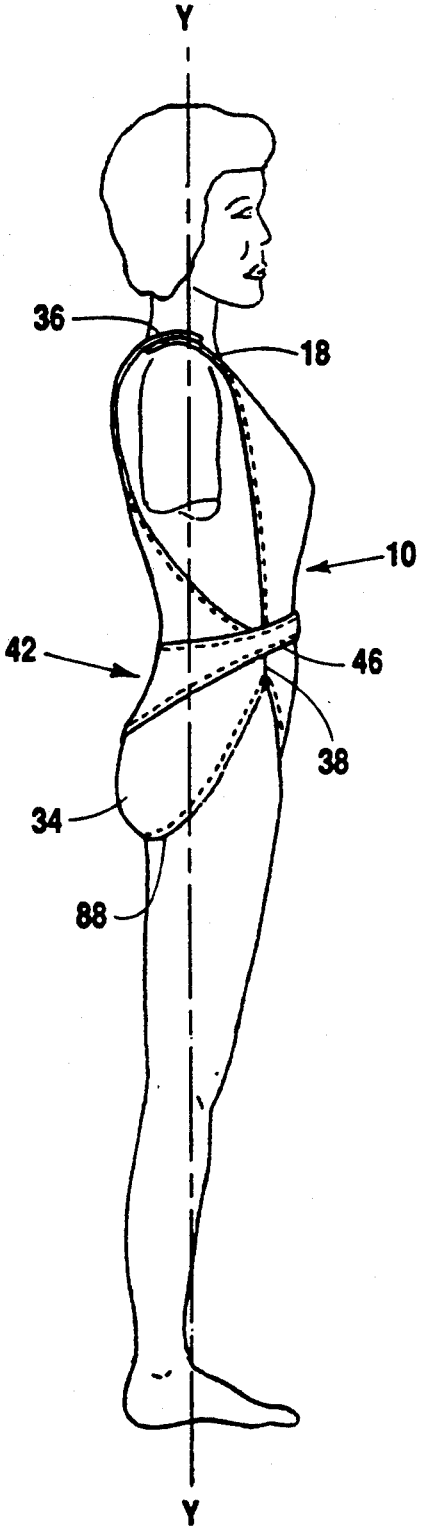
FIG. 3 is a right side view of the exercise garment of the present invention as worn by a person.
Figure 4:
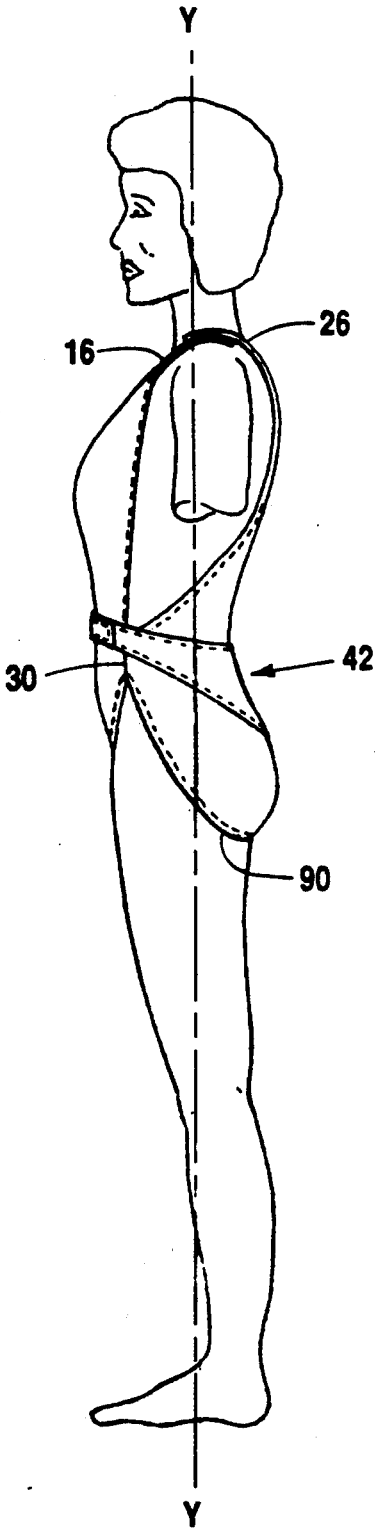
FIG. 4 is a left side view of the exercise garment of the present invention as worn by a person.

Referring to FIG. 3 and FIG. 4, the garment 10 is shown as worn by a person having a coronal plane Y—Y extending through the longitudinal center line or axis of the person perpendicular to the sagittal plane. Plane Y—Y divides the body into anterior (ventral) and posterior (dorsal) sections. Further, it is to be understood that during usage of the garment 10 side seams 30 and 38 are on the anterior or ventral side of plane Y—Y.

Figure 5:
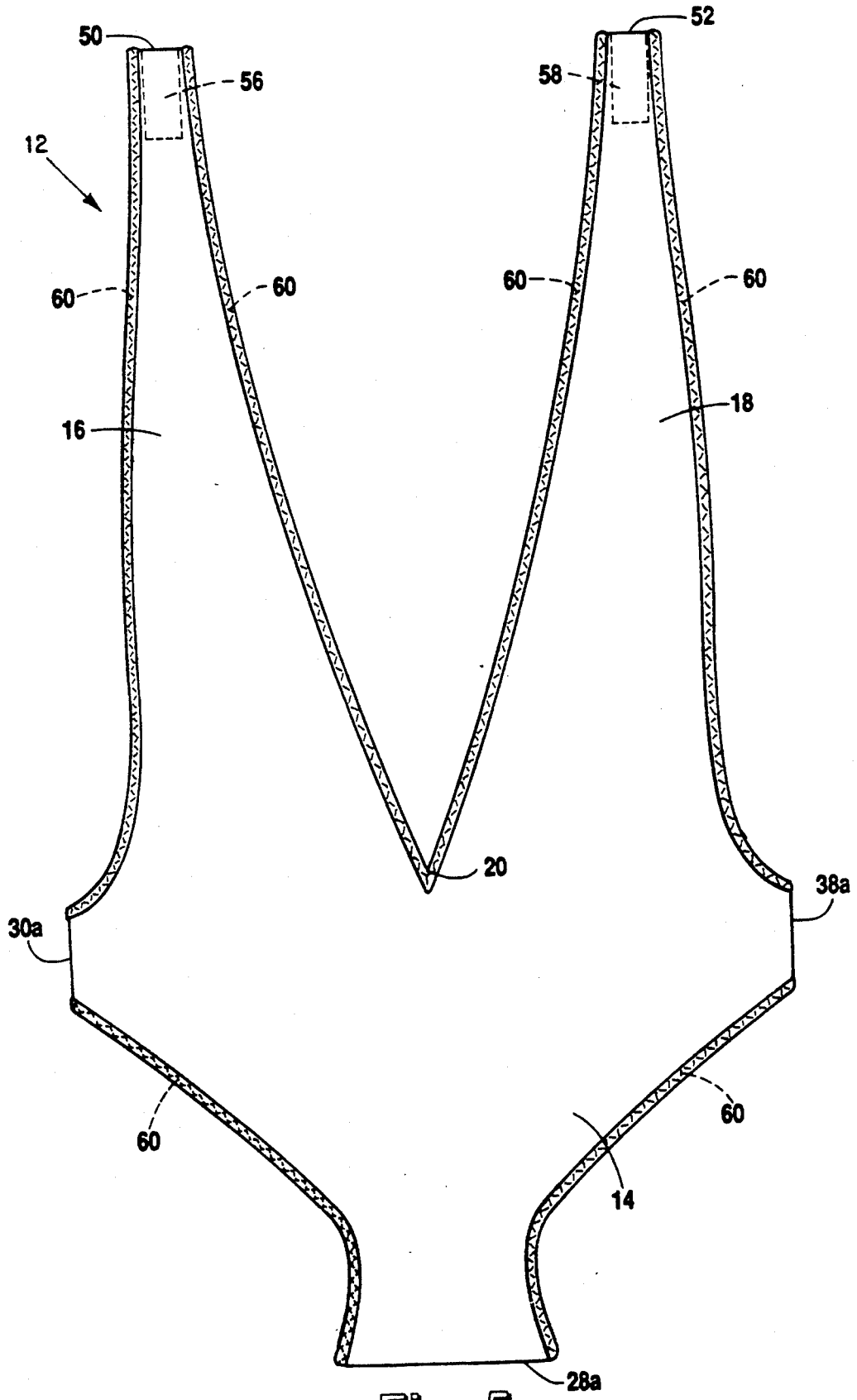
FIG. 5 is a plan view of the inside of the front panel of the exercise garment of the present invention.

Referring to FIG. 5, the front panel 12 will be described in greater detail. Panel 12 has a lowermost edge 28*a* which is sewn to panels 22 and 32 in a zig zag stitch to form crotch seam 28. Panel 12 has a left side edge 30*a* which is sewn to left rear panel 22 at seam 30 and a right side edge 38*a* which is sewn to right rear panel 32 at seam 38. Straps 16 and 18 intersect at apex 20. Left strap 16 tapers from edge 30*a* and apex 20 to left upper edge 50. Right strap 18 tapers from edge 38*a* and apex 20 to right upper edge 52. A rectangular patch of hooks or loops 56 of hook and loop fastener means, such as VELCRO, is sewn to strap 16 adjacent to edge 50. Likewise, a rectangular patch of hooks or loops 58 of hook and loop fastener means, such as VELCRO, is sewn to strap 18 adjacent to edge 52. Elastic 60 is sewn along the sides of strap 16 from edge 30*a* and apex 20 to edge 50 in a zig zag stitch and such sides of strap 16 are folded over and hemmed in a zig zag stitch. Likewise, elastic 60 is sewn along the sides of strap 18 from edge 38*a* and apex 20 to edge 52 in a zig zag stitch and such sides of strap 18 are folded over and hemmed in a zig zag stitch. Elastic 60 is also sewn along the sides of area 14 from edge 28*a* to edges 30*a* and 38*a* in a zig zag stitch and such sides of area 14 are folded over and hemmed in a zig zag stitch.

Figures 6, 7:
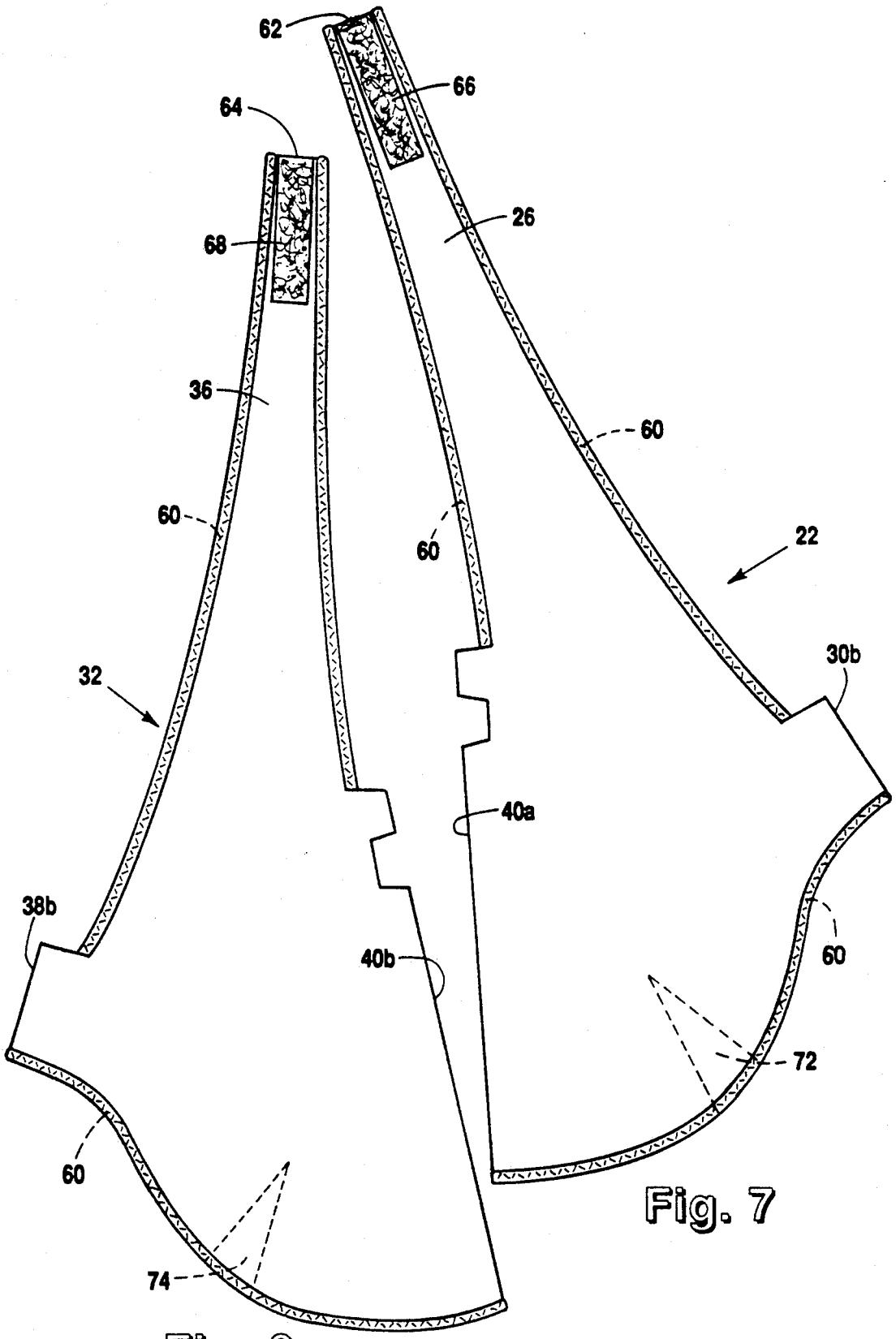
FIG. 6 is a plan view of the inside of the right rear panel of the exercise garment of the present invention.
FIG. 7 is a plan view of the inside of the left rear panel of the exercise garment of the present invention.

Referring to FIG. 6 and FIG. 7, rear panels 22 and 32 will be described in greater detail. Left rear panel 22 has a side edge 40*a* and right rear panel 32 has a side edge 40*b*. Edges 40*a* and 40*b* are sewn together in a zig zag stitch to form seam 40. Panel 22 has a side edge 30*b* which is sewn to edge 30*a* in a zig zag stich to form seam 30. Panel 32 has a side edge 38*b* which is sewn to edge 38*a* in a zig zag stitch to form seam 38. Panel 22 has an upper edge 62 and is tapered from side edges 30*b* and 40*a* to edge 62. Strap 32 has an upper edge 64 and is tapered from side edges 38*b* and 40*b* to edge 64. A rectangular patch of hooks or loops 66 of hook and loop fastener means, such as VELCRO, is sewn to strap 26 adjacent to edge 62. Hooks or loops 66 are adapted for mating engagement with hooks or loops 56 such that if 66 is hooks, 56 is loops and vice versa. Likewise, a rectangular patch of hooks or loops 68 of hook and loop fastener means, such as VELCRO, is sewn to strap 36 adjacent to edge 64. Hooks or loops 68 are adapted for mating engagement with hooks or loops 58 such that if 68 is hooks, 58 is loops and vice versa. Elastic 60 is sewn in a zig zag stitch along the sides of strap 26 from edges 30*b* and 40*a* to edge 62 and such sides of strap 26 are folded over and hemmed in a zig zag stitch. Likewise, elastic 60 is sewn in a zig zag stitch along the sides of strap 36 from edges 38*b* and 40*b* to edge 64 and such sides of strap 36 are folded over and hemmed in a zig zag stitch. Elastic 60 is also sewn in a zig zag stitch along the lowermost edge of panel 22 from edge 30*b* to edge 40*b* and such lowermost edge of panel 22 is folded over and hemmed in a zig zag stitch. Likewise, elastic 60 is sewn in a zig zag stitch along the lowermost edge of panel 32 from edge 38*b* to edge 40*b* and such lowermost edge of panel 32 is folded over and hemmed in a zig zag stitch. Panels 22 and 32 are also provided with ease tucks 72 and 74, respectively.

Figures 8, 9:
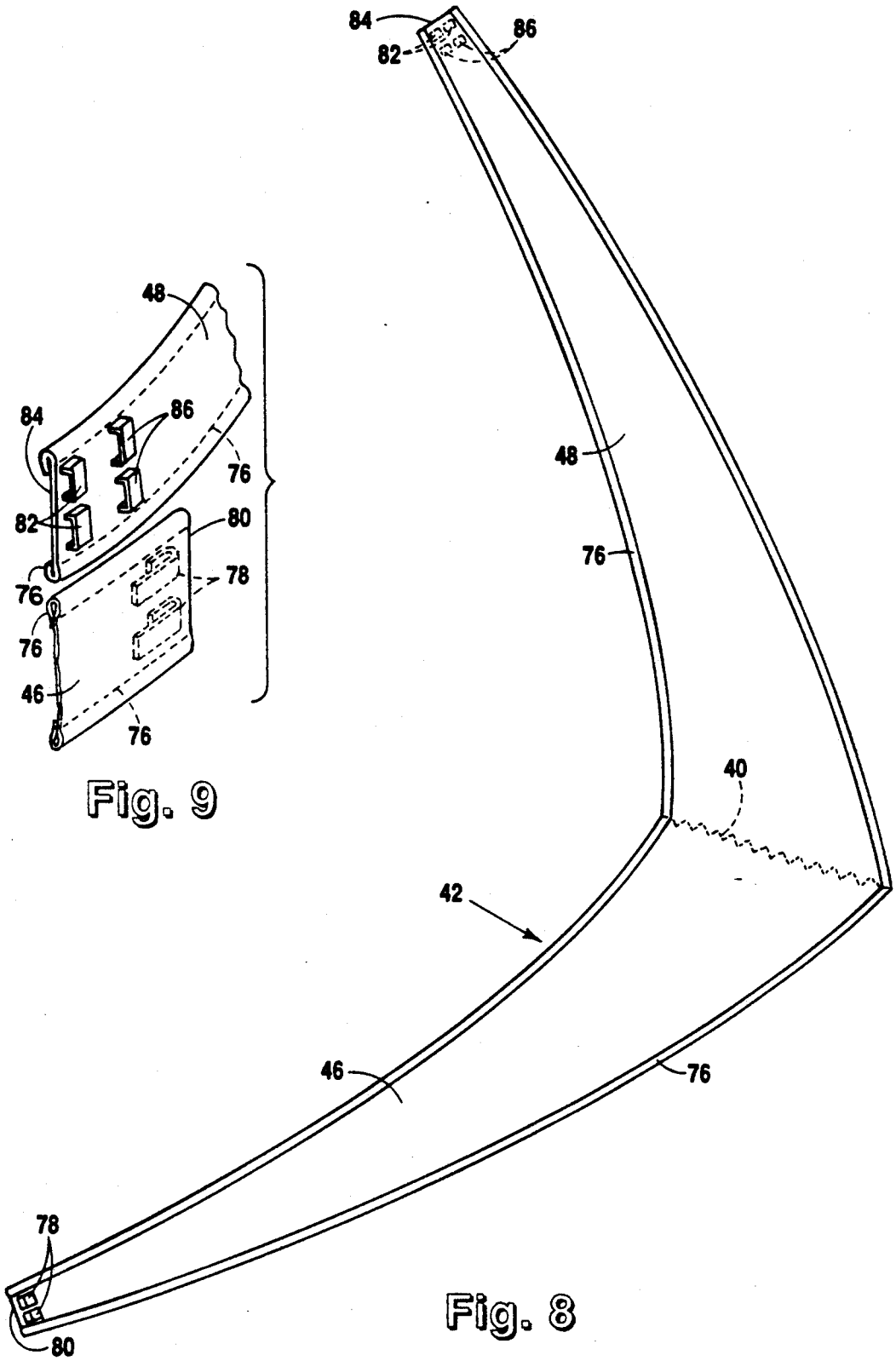
FIG. 8 is a plan view of the inside of the belt of the exercise garment of the present invention.
FIG. 9 is a perspective view of the adjustable ends of the exercise garment belt.

Referring to FIG. 8 and FIG. 9, the belt 42 will be described in greater detail. Belt 42 is generally V-shaped and hemmed in a zig zag stitch at 76 along its upper and lower edges. A pair of hooks 78 are sewn to strap 46 adjacent edge 80. A first pair of eyes 82 are sewn to strap 48 adjacent to edge 84 and a second pair of eyes 86 are sewn to strap 48 adjacent to eyes 82. Hooks 78 are adapted for releasable engagement with each pair of eyes 82 and 86 to permit adjustment of the belt 42 to the desired tightness. Belt 42 is sewn to rear panels 22 and 32 at seam 40 at approximately the center of belt 42, as illustrated in FIG. 8 by hidden line 40.

The garment 10 is adapted to be worn under or as the clothing of a person during exercise. The person simply inserts their right leg through the right leg hole 88 defined by front panel 12 and rear panel 32 and their left leg through the left leg hole 90 defined by front panel 12 and rear panel 22. Lower buttocks area 24 is positioned about the left buttocks or gluteal region and lower buttocks area 34 is positioned about the right buttocks or gluteal region. Straps 16, 18, 26, and 36 are thereafter pulled up to the shoulders of the person. Strap 36 is pulled forward so as to overlap strap 18 and press thereagainst so that hook and loop fastener means 58 and 68 are in releasable mating engagement. Likewise, strap 26 is pulled forward so as to overlap strap 16 and press thereagainst so that hook and loop fastener means 56 and 66 are in releasable mating engagement. It is to be understood that the V-shaped openings 19 and 39 allows the straps 16, 18, 26 and 36, respectively, to be pulled upward. Further, straps 16 and 26 may be adjustably connected to provide the desired upward pull of area 24 and resultant support of the wearer's left side gluteal region or buttocks area. Likewise, straps 18 and 36 may be adjustably connected to provide the desired upward pull of area 34 and resultant support of the wearer's right side gluteal region or buttocks area. Belt 42 is thereafter pulled upward and forward (toward the front of the person) and fastened at approximately the waist of the person by releasably hooking hooks 78 into eyes 82 or 86, depending upon the desired tightness of the belt 42.

It is to be understood that the garment 10 enables the wearer's shoulders to provide direct support to the gluteal region by the straps 16, 26 and 18, 36 pulling from the shoulders. This directly supports the seat area or gluteal region and indirectly supports the lower back and pelvic region by relieving the lower back and pelvic region from gravity stress during excercise. Further, the belt 42 provides additional direct lateral support to the lower back and gluteal region.

The present invention therefore further provides a method for supporting the lower back and pelvic region of a person during exercise comprising the steps of positioning a garment panel about the gluteal region or buttocks area of the person, pulling the garment upward from the shoulders of the person, and fastening a belt about the waist of the person, the belt being connected to approximately the center of the garment panel. The fastening step comprises the steps of pulling the belt upward and forward about the waist of the person and securing opposite ends of the belt at a desired tightness.

It is to be understood that the garment 10 (other than the elastic 60, the hook and loop fastener means, hooks and eyes, and stitching) is preferably constructed of stretchabie material, such as heavy spandex or Lycra. In this regard, the zig zag stitching facilitates the stretching of the material. Further, buttocks areas 24 and 34 are preferably "full cut." It is also to be understood that straps 16, 18, 26, and 36 preferably have a width at their narrowest point in the range of approximately one inch (1") to one and one half inches (1½"). Further, side seams 30 and 38 preferably have a length of approximately four inches (4"), elastic 60 preferably has a width of approximately five eighths inches (⅝"). Finally, it is to be understood that appropriate hook and loop fastener means, such as VELCRO, may be substituted for the hooks and eyes on belt 42 and that hooks and eyes may be substituted for the hook and loop fastener means for connecting straps 16 and 26 and 18 and 36.

While the exercise garment of the present invention has been described in connection with the preferred embodiment, it is not intended to limit the invention to the particular form set forth, but on the contrary, it is intended to cover such alternatives, modifications, and equivalents as may be included within the spirit and scope of the invention as defined by the appended claims.

I claim:

1. A garment for use by a person during exercise or physical activity, comprising:

a left rear panel having a left rear panel strap and a right rear panel having a right rear panel strap, said left rear panel and right rear panel being connected and being generally full cut for positioning about a rear gluteal region of said person;

a front panel connected to said rear panels at a crotch area and at a left and right side, said left and right side connections being forward of a coronal plane of said person during usage of said garment, said front panel having a left front panel strap and a right front panel strap adapted to be connected to said left rear panel strap and said right rear panel strap, respectively, for lifting said gluteal region and supporting the lower back and gluteal/pelvic region of said person; and a generally V-shaped belt connected at approximately the position of said connection of said rear panels and having a left end and a right end adapted to be fastened, said ends being pulled forward and upward and fastened at approximately the waist of said person for supporting said gluteal region during usage of said garment.

2. A garment for use by a person during exercise or physical activity, as recited in claim 1, wherein said left rear panel and right rear panel are connected to each other such that said connection of said rear panels lies approximately within the median sagittal plane of said person during usage of said garment.

3. A garment for use by a person during exercise or physical activity, as recited in claim 1, wherein said front panel defines a generally V-shaped opening and said ends of said belt are adapted to be adjustably fastened.

4. A garment for use by a person during exercise or physical activity, as recited in claim 1, further comprising hook and loop fastener means for adjustably connecting said left front panel strap and left rear panel strap and said right front panel strap and right rear panel strap.

5. A garment for use by a person during exercise or physical activity, comprising:

a left rear panel having a left rear panel strap and a right rear panel having a right rear panel strap, said left rear panel and right rear panel being connected and being generally full cut for positioning about a rear gluteal region of said person;

a front panel connected to said rear panel at a crotch area and at a left and right side, said left and right side connections being forward of a coronal plane of said person during use of said garment, said front panel having a left front panel strap and a right front panel strap adapted to be connected to said left rear panel strap and said right rear panel strap, respectively, for lifting said gluteal region and supporting the lower back and gluteal/pelvic region of said person, said front panel defining a generally V-shaped opening; and a generally V-shaped belt connected at approximately the position of said connection of said rear panels and having a left end and a right end adapted to be fastened, said ends being pulled forward and upward and fastened at approximately the waist of said person for supporting said gluteal region during usage of said garment.

6. A garment for use by a person during exercise or physical activity, comprising:

a left rear panel having a left rear panel strap and a right rear panel having a right rear panel strap, said left rear panel and right rear panel being connected and being generally full cut for positioning about a rear gluteal region of said person and defining a generally V-shaped opening;

a front panel connected to said left rear panel and right rear panel at a crotch area and at a left and right side, said left and right side connections being forward of a coronal plane of said person during use of said garment, said front panel having a left front panel strap and a right front panel strap adapted to be adjustably connected to said left rear panel strap and said right rear panel strap, respectively, for lifting said gluteal region and supporting the lower back and gluteal/pelvic region of said person, said front panel defining a generally V-shaped opening, whereby said straps provide support to said person's lower back and gluteal/pelvic region by pulling up from the shoulders of said person; and a generally V-shaped belt connected at approximately the position of said connection of said rear panels and having a left end and a right end adapted to be fastened, said ends being pulled forward and upward and fastened at approximately the waist of said person during usage of said garment.

7. A method for supporting the gluteal/pelvic region of a person during exercise or physical activity, comprising the steps of:

positioning a garment panel about a gluteal region of said person, said garment panel comprising a left rear panel having a left rear panel strap and a right rear panel having a right rear panel strap, said left rear panel and said right rear panel being connected and being generally full cut for positioning about said gluteal/pelvic region of said person, and further comprising a front panel connected to said rear panels at a crotch area and at a left and right side, said left and right side connections being forward of a coronal plane of said person during usage of said garment, said front panel having a left front panel strap and a right front panel strap adapted to be connected to said left rear panel strap and said right rear panel strap, respectively, for lifting said gluteal region and supporting the lower back and said gluteal/pelvic region of said person;

pulling said garment panel upward from the shoulders of said person; and fastening a generally V-shaped belt about a waist of said person, said belt having a left end and a right end adapted to be fastened and said belt being connected at approximately the position of said connection of said rear panels.

8. A method for supporting the gluteal/pelvic region of a person, as recited in claim 7, wherein said fastening step comprises the step of pulling said belt upward and forward about the waist of said person.

9. A method for supporting the gluteal/pelvic region of a person, as recited in claim 8, further comprising the step of securing opposite ends of said belt at a desired tightness about the waist of said person.

10. A garment for use by a person during exercise or physical activity, comprising:

a left rear panel having a left rear panel strap and a right rear panel having a right rear panel strap, said left rear panel and right rear panel being connected and being generally full cut for positioning about a rear gluteal region of said person, each of said rear panels comprising a single piece of stretchable material;

a front panel connected to said rear panels at a crotch area and at a left and right side, said left and right said connections being forward of a coronal plane of said person during usage of said garment, said front panel having a left front panel strap and a right front panel strap adapted to be connected to said left rear panel strap and said right rear panel strap, respectively, for lifting said gluteal region and supporting the lower back and gluteal/pelvic region of said person; and a generally V-shaped belt connected to said rear panels below the horizontal waistline of said person during usage of said garment and having a left end and a right end adapted to be fastened, said ends being pulled forward and upward and fastened at approximately the waist of said person for supporting said gluteal region during usage of said garment.

11. A garment for use by a person during exercise or physical activity, as recited in claim 1, wherein said left rear panel and right rear panel define a generally V-shaped opening.

12. A garment for use by a person during exercise or physical activity, as recited in claim 3, wherein said left rear panel and right rear panel define a generally V-shaped opening.

13. A garment for use by a person during exercise or physical activity, as recited in claim 5, wherein said left rear panel and right rear panel define a generally V-shaped opening.

14. A garment for use by a person during exercise or physical activity, as recited in claim 10, wherein said left rear panel and right rear panel define a generally V-shaped opening.

15. A garment for use by a person during exercise or physical activity, as recited in claim 1, wherein said left front panel strap and said right front panel strap are adapted to be adjustably connected to said left rear panel strap and said right rear panel strap, respectively.

16. A garment for use by a person during exercise or physical activity, as recited in claim 3, wherein said left front panel strap and said right front panel strap are adapted to be adjustably connected to said left rear panel strap and said right rear panel strap, respectively.

17. A garment for use by a person during exercise or physical activity, as recited in claim 5, wherein said left front panel strap and said right front panel strap are adapted to be adjustably connected to said left rear panel strap and said right rear panel strap, respectively.

18. A garment for use by a person during exercise or physical activity, as recited in claim 10, wherein said left front panel strap and said right front panel strap are adapted to be adjustably connected to said left rear panel strap and said right rear panel strap, respectively.

19. A garment for use by a person during exercise or physical activity, as recited in claim 6, wherein said ends of said belt are adapted to be adjustably fastened.

20. A garment for use by a person during exercise or physical activity, as recited in claim 10, wherein said ends of said belt are adapted to be adjustably fastened.

* * * * *